United States Patent [19]

Charette et al.

[11] Patent Number: 4,569,655

[45] Date of Patent: Feb. 11, 1986

[54] POCKET SIZED PORTABLE SMOKE RAISER

[76] Inventors: Jacqueline M. Charette, 97 Georgia Ave., Lowell, Mass. 01852; Mico H. Kaufman, 23 Marion Dr., North Tewksbury, Mass. 01876

[21] Appl. No.: 567,422

[22] Filed: Dec. 30, 1983

[51] Int. Cl.[4] ..... F23D 3/16

[52] U.S. Cl. ..... 431/290; 431/291; 362/162; 362/163

[58] Field of Search ..... 431/291, 253, 289, 290, 431/310–313; 362/161–163; 55/385 G; 131/329

[56] References Cited

U.S. PATENT DOCUMENTS

| | | | |
|---|---|---|---|
| 464,486 | 12/1891 | von der Hoya | 362/162 |
| 1,091,248 | 3/1914 | Sarkadi | 362/161 |
| 2,080,251 | 5/1937 | Buskard | 431/291 |
| 2,146,441 | 2/1939 | Powers | 431/290 |
| 3,490,466 | 1/1970 | Warnock | 55/385 G |
| 3,556,704 | 1/1971 | Grasznick | 431/290 |
| 3,733,168 | 5/1973 | Marsh et al. | 431/253 |
| 4,186,430 | 1/1980 | Britton | 362/162 |

FOREIGN PATENT DOCUMENTS

| | | | |
|---|---|---|---|
| 80804 | 6/1920 | Austria | 431/291 |

*Primary Examiner*—Carroll B. Dority, Jr.
*Attorney, Agent, or Firm*—Pearson & Pearson

[57] ABSTRACT

A portable candle stand with movable flame shields for directing cigarette or cigar smoke in an upward direction away from the irritation level of non-smokers. The device comprises a base which houses at least one candle and opposed, adjustable flame shields or baffles. When in use, the flame shields may be raised to a level above the candle flame, thereby directing any smoke present in an upward direction. Consequently, non-smokers may carry the device to meetings, etc. and avoid the irritating and discomforting effects caused by the smoking public. The stand is of pocket or handbag size and made of non-flammable material.

1 Claim, 6 Drawing Figures

Fig. 1
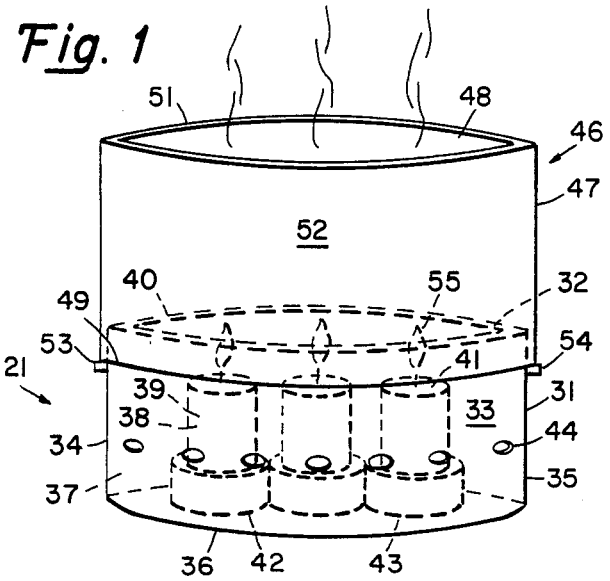
Fig. 2
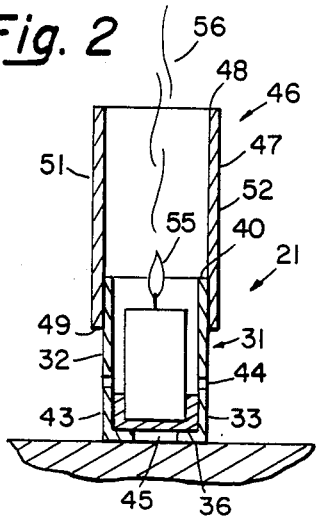
Fig. 3
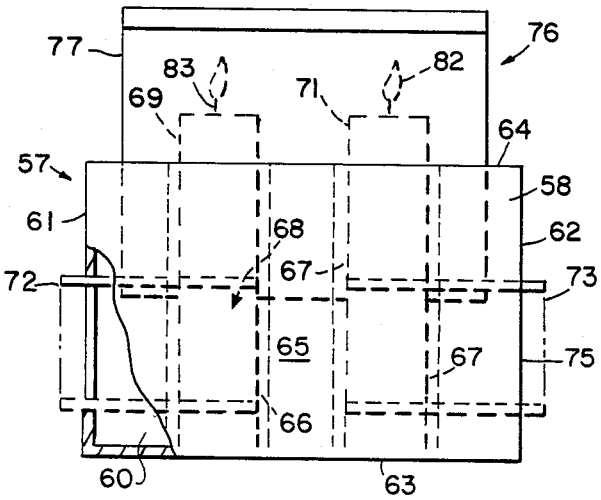
Fig. 4
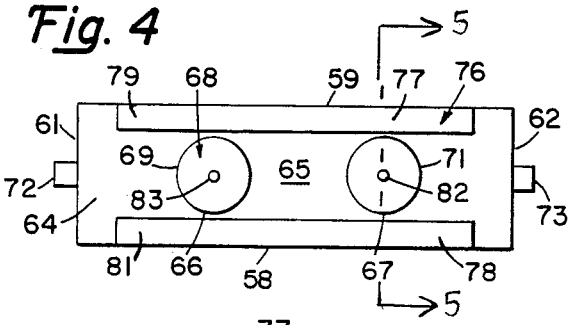
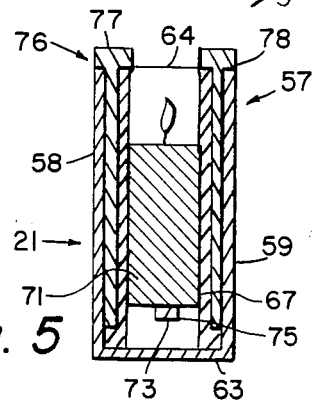
Fig. 5
Fig. 6
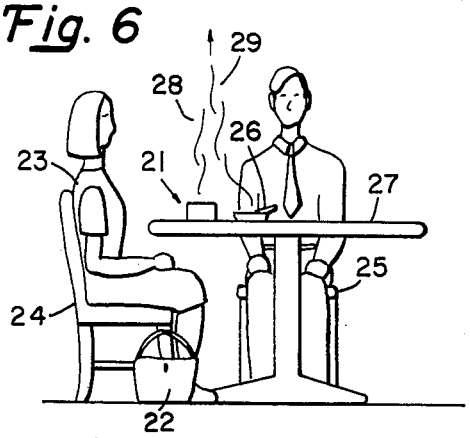

POCKET SIZED PORTABLE SMOKE RAISER

BACKGROUND OF THE INVENTION

It has heretofore been proposed to provide a smoke raiser in the form of lamps wherein there is an ashtray at the bottom and some type of tubular chimney extending thereabove which supports an electric bulb and lamp shade, as exemplified in U.S. Pat. No. 2,265,903 to Hartje of Dec. 9, 1941. A similar ashtray with chimney using a candle as the heat source is disclosed in U.S. Pat. No. 3,490,466 to Warnock of Jan. 20, 1970. A liquid fuel type flame, ashtray, and chimney tube is shown in U.S. Pat. No. 3,733,168 to Marsh, et al of May 15, 1973.

The concept of combining ashtrays with candle holders as decorative household novelties is taught in U.S. Pat. No. 2,428,116 to Jensen of Sept. 30, 1947 and U.S. Pat. No. 3,160,162 to Nunez of Dec. 8, 1964.

However, these prior art devices all include an ashtray for a smoker, with the resulting smoke generated by the tobacco therein. They are far removed from the object of this invention which is to avoid smoke and prevent its contact with the device or with the user.

In addition, while some of the above patents use the word portable, in the sense that the device can be bodily transported around a room from table to table, none of the devices are so constructed and arranged that they can be fitted into the pocket, or bag, carried to a meeting, or restaurant, and placed on a table to raise the objectionable smoke of a neighbor's cigarette up toward the ceiling.

SUMMARY OF THE INVENTION

In this invention, the pocket, or handbag sized smoke raiser has no ashtray whatever, and preferably has an elongated, relatively thin body which will fit in a pocket or handbag, and when placed on a table will form an imperforate, effective barrier to smoke from others at the table. The interior of the body contains at least one, and preferably a plurality of, individual candles aligned longitudinally therewithin, which can have their wicks lit in situ, or preferably after they have been raised up above the level of the top wall of the body. When lit, the flames thus create a curtain of flame which in turn creates an upwardly directed flow of heated air which carries up toward the ceiling any smoke from the cigarette, pipe, or cigar of the smoker sitting nearby.

Preferably the smoke raiser of the invention includes a pair of oppositely disposed flame shields, or baffles, which are normally retracted against, or into, the sides of the body, but are movable to a position each on an opposite side of the elongated heat means, formed by the candle flames to prevent extinguishment by stray breezes while hiding the light therefrom.

At the end of a meeting, or at the end of a meal in a restaurant, the candle flames are extinguished, the candles retracted into the body, the elongated flame shields are retracted, and the smoke raiser placed back in the pocket, or handbag for use on another similar occasion.

BRIEF DESCRIPTION OF THE DRAWING

FIG. 1 is a side elevational view of a smoke raiser constructed in accordance with the invention;

FIG. 2 is an end elevational view thereof, in half section;

FIG. 3 is a view similar to FIG. 1, but diagrammatic, of another embodiment of the invention;

FIG. 4 is a top plan, diagrammatic, view of the device shown in FIG. 3;

FIG. 5 is an end elevational, diagrammatic, view in section on line 5—5 of FIG. 4 showing the device of FIG. 3 with the shields retracted; and FIG. 6 is a small scale view showing the smoke raiser of the invention in use on a table, as a barrier to the smoke of a nearby chair occupant.

DESCRIPTION OF A PREFERRED EMBODIMENT

As best shown in FIG. 6, the smoke raiser 21 of the invention is intended to be so shaped and dimensioned that it can be easily carried in the pocket or handbag 22, of a user 23, sitting in a chair 24, next to the chair 25, of a person smoking a pipe, cigar, or cigarette 26. In such case, the user 23 simply places the smoke raiser 21, on the table 27, lights the candles, raises the shields, and thereafter, the smoke 28 is directed up to the ceiling by the up-flowing air current 29 generated by the flame of the candles.

One form of the smoke raiser 21 of the invention is shown in FIGS. 1 and 2. It comprises an elongated, relatively thin body 31, five or six inches in length, with a pair of opposite, elongated arcuate side walls 32 and 33, spaced apart about one inch in the central portion, but closely spaced at the opposite terminal end walls 34 and 35. It will be understood that the ovoid, streamlined shape of body 21 is mainly for aesthetic design reasons, and that it could also be of cylindrical, rectangular, or other desired shapes.

Body 21 includes a bottom wall 36, and a top opening 40, which may have a cover, not shown, if desired. The bottom wall enables it to stand upright on a table 27 as shown in FIG. 6. Body 21 includes an interior compartment 37 in which heat means 38, preferably in the form of at least two candles 39 and 41 are located, each seated in a suitable socket 42 or 43.

A row of apertures such as 44 extends along the lower portion of each side wall 32 and 33 to admit air. Each socket is movable from the retracted position shown in FIG. 2, upwardly within compartment 37, by a finger inserted in one of the finger holes such as 45, in the bottom wall 36, as the candle burns down or for replacement.

The smoke raiser 21 also includes shield means 46, of opaque material, which in the embodiment of FIGS. 1 and 2 comprises an annular, hollow, tubular shield 47 having open upper and lower ends 48 and 49, and elongated side walls, or shields 51 and 52, substantially coextensive in length with, and each extending alongside one of, the side walls 32 and 33 of body 21.

The shield 47 is slidably sleeved on the exterior of body 31 to move from a retracted position down at the level thereof, to the upward position, above spring pressed stops 53 and 54, and above the level of top 40 of body 31 to protect the flame 55, of the candles from ambient air currents, while hiding the light therefrom and creating a chimney draft for the upward flow of hot combustion gas indicated at 56. The material of body 31 and shield 47, is preferably non-inflammable, such as sheet metal, and since it has no apertures near table level which could pass low lying clouds of cigarette smoke, it effectively directs all smoke up toward the ceiling when in use.

In FIGS. 3, 4, and 5 another embodiment of the smoke raiser of the invention is shown in which the body 57 is generally cubical with elongated side walls 58 and 59, end walls 61 and 62, bottom wall 63 and top wall 64, the body being relatively thin and of non-inflammable material 65. An interior compartment 60 is formed within body 57 in which two-candle receiving sockets 66 and 67 depend downwardly from top wall 64 to the bottom wall 63. (FIG. 5)

Heat means 68 in the form of candles 69 and 71 each normally retracted in their respective sockets 66 or 67, but each being movable upwardly by the handles 72 or 73, slidable in slots 74 or 75, to the position shown in FIG. 1 with their wicks and flames above the level of top wall 64.

In this embodiment the shield means 76 comprises a pair of generally rectangular shields 77 and 78, each vertically slidably in an elongated slot 79 or 81 in top wall 64, from retracted position, within the confines of the body 57, below the level of top wall 64, to raised position where each extends along each opposite side of the body above the level of top 64. In the raised position the shields 77 and 78 hide the flame 82 from the candle wicks 83 while preventing extinguishment by ambient air currents and creating a chimney like upward draft for the combustion gases from the candle flame.

It is to be understood that heat means other than wax candles can be used in the smoke raiser of the invention such as propane gas candles or even electric resistance heat devices, but wax candles are preferred for ease of substitution, safety and low cost.

An alternate design may include a lid for the container of the smoke raiser which, when removed, may be attached to the bottom of the container in the same manner in which it served as a lid.

We claim:

1. In a smoke raiser, the combination of:

a small, portable, pocket, or handbag size, thin, elongated body of non-inflammable material, having a pair of opposite, elongated side walls of predetermined length and height, a pair of opposite ends, a bottom and a top opening all jointly defining an elongated, thin, interior compartment;

at least two longitudinally aligned candle receiving sockets extending vertically in said compartment;

a candle in each said candle receiving socket, normally housed within said compartment, below the level of said top opening;

means for raising said candles to position the wicks thereof above the level of said top opening;

and a pair of shields of opaque material, each extending along one of the opposite sides of said body and substantially co-extensive in length and height therewith, each said shield being slidably mounted relative to said body to move from a retracted position at the level of said side walls to an operative position above the level of said top opening to shield the flame from each said candle while creating an updraft;

said body including a top wall closing said top opening about said candle receiving sockets and said top wall having a pair of elongated slots, each on an opposite side of said elongated interior compartment and each said shield is vertically slidable in one of said slots between said operative and retracted positions.

* * * * *